United States Patent [19]

Hanson

[11] 4,072,414

[45] Feb. 7, 1978

[54] SCREEN FOR AN ELECTROPHOTOGRAPHIC PRINTING MACHINE

[75] Inventor: William J. Hanson, Macedon, N.Y.

[73] Assignee: Xerox Corporation, Stamford, Conn.

[21] Appl. No.: 736,989

[22] Filed: Oct. 29, 1976

[51] Int. Cl.[2] ..... G03G 15/01

[52] U.S. Cl. ..... 355/4; 96/45; 96/116

[58] Field of Search ..... 355/4, 3 R, 11; 96/116, 96/45, 118, 1.2

[56] References Cited

U.S. PATENT DOCUMENTS

| | | | |
|---|---|---|---|
| 2,598,732 | 6/1952 | Walkup | 96/45 X |
| 3,905,822 | 9/1975 | Marks | 96/45 X |
| 4,027,962 | 6/1977 | Mailloux | 355/4 |

*Primary Examiner*—R. L. Moses

*Attorney, Agent, or Firm*—J. J. Ralabate; C. A. Green; H. Fleischer

[57] ABSTRACT

An electrophotographic printing machine in which a transparency light image is projected through a screen having a plurality of opaque regions. At least a portion of the opaque regions have a light reflecting surface on one side thereof and a light absorbing surface on the other side thereof. The screen is positioned so that the light reflecting surfaces of the opaque regions form a visual image of the transparency light image being projected therethrough. Incident light rays are absorbed by the absorbing surfaces of the opaque regions.

15 Claims, 4 Drawing Figures

SCREEN FOR AN ELECTROPHOTOGRAPHIC PRINTING MACHINE

BACKGROUND OF THE INVENTION

This invention relates generally to an electrophotographic printing machine, and more particularly concerns a screen for extending the range thereof.

In the process of electrophotographic printing, a photoconductive member is charged to a substantially uniform level. A light image of an original document irradiates the charged portion of the photoconductive member dissipating selectively the charge thereon in accordance with the intensity thereof. In this manner, an electrostatic latent image is recorded on the photoconductive member corresponding to the original document being reproduced. The electrostatic latent image is then developed with heat settable toner particles. The toner particles are then transferred from the latent image to a sheet of support material, in image configuration. Heat is then applied to the particles permanently affixing them to the sheet of support material.

Multi-color electrophotographic printing employs a plurality of cycles. Each cycle reproduces a different color contained in the original document. This requires that the light image of the original document be filtered to record an electrostatic latent image corresponding to a single color of the original document. The latent images are developed with appropriately colored toner particles. The toner particles are then transferred to the sheet of support material, in superimposed registration with one another. In this way, a multi-layered toner powdered image is formed on the sheet of support material. This toner powder image is permanently affixed to the sheet of support material by the application of heat to produce a permanent color copy of the original document.

In the past, it has been difficult to produce copies having subtle variations of tone or color. Hence, the reproduction of color slides as opaque copies having pictorial quality has been difficult. In order to overcome this problem, a half tone screen is frequently interposed in the optical light path. This screen produces tone gradations by forming half-tone dots or lines of varying size. In the highlight zones, the dots are small and increase in size through the intermediate shades until they merge together in the shadow regions. At the highlight ends of the tone scale there will be complete whiteness, while at the shadow end there will be nearly solid blackness. Numerous patents describe the concept of screening. Exemplary of these patents are U.S. Pat. Nos. 2,498,732; 3,535,036; 3,121,010; 3,193,381; 3,776,633; and 3,809,555.

In addition to the generally available commercial copying machines arranged to reproduce opaque original documents as opaque copies, many types of printing machines are in wide use for reproducing microfilm. For example, U.S. Pat. Nos. 3,424,525; 3,542,468; and 3,547,533 describe typical microfilm copying machines. Once again, in microfilm copying machines as well as in opaque copying machines, it has been extremely difficult to form copies of transparencies wherein the copy will have pictorial quality. This problem has become more paramount with the advent of multi-color electrophotographic printing machines. In a multi-color electrophotographic printing machine, it is highly desirable to have the capability of reproducing color transparencies, such as 35 mm slides. However, it is required that the copy produced therefrom be of pictorial quality. This requires that a half-tone screen be employed. One type of system employing a half-tone screen for the reproduction of color transparencies is described in copending U.S. application Ser. No. 540,617 filed in 1975. As described therein, a light image of the color transparencies is projected through a half-tone screen disposed on the platen of the electrophotographic printing machine. Normally, the light being projected through the screen is not visible to the eye of the machine operator. In order to determine the focus or lack thereof, the operator will frequently position a sheet of white paper on the screen so as to see the light image being projected through the screen.

One type of screen taught by the prior art is a compound screen. This screen is described in U.S. Pat. No. 3,905,822 issued to Marks in 1975. The screen includes a clear transparent base member having a mixed dot pattern of light absorbing and light reflecting dots.

It is a primary object of the present invention to improve the screen employed in an electrophotographic printing machine reproducing transparencies by having the light image of the transparency visible on the surface of the screen member.

SUMMARY OF THE INVENTION

Briefly stated, and in accordance with the present invention there is provided an electrophotographic printing machine for reproducing a transparency.

Pursuant to the features of the present invention, the electrophotographic printing machine includes a photoconductive member and means for charging at least a portion of the photoconductive member to a substantially uniform level. Means are provided for projecting a light image of the transparency through a screen member onto the charged portion of the photoconductive member. This records a modulated electrostatic latent image on the photoconductive member. In particular, the present invention is directed to a screen member having a plurality of opaque regions. At least a portion of the opaque members have a light reflecting surface on one side thereof and a light absorbing surface on the other side thereof. The screen member is positioned so that the reflecting surfaces of the opaque regions form a visual image of the transparency, while the absorbing surfaces of the opaque regions absorb incident light rays.

BRIEF DESCRIPTION OF THE DRAWINGS

Other objects and advantages of the present invention will become apparent upon reading the following detailed description and upon reference to the drawings, in which.

While the present invention will hereinafter be described in connection with a preferred embodiment thereof, it will be understood that it is not intended to limit the invention to this embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
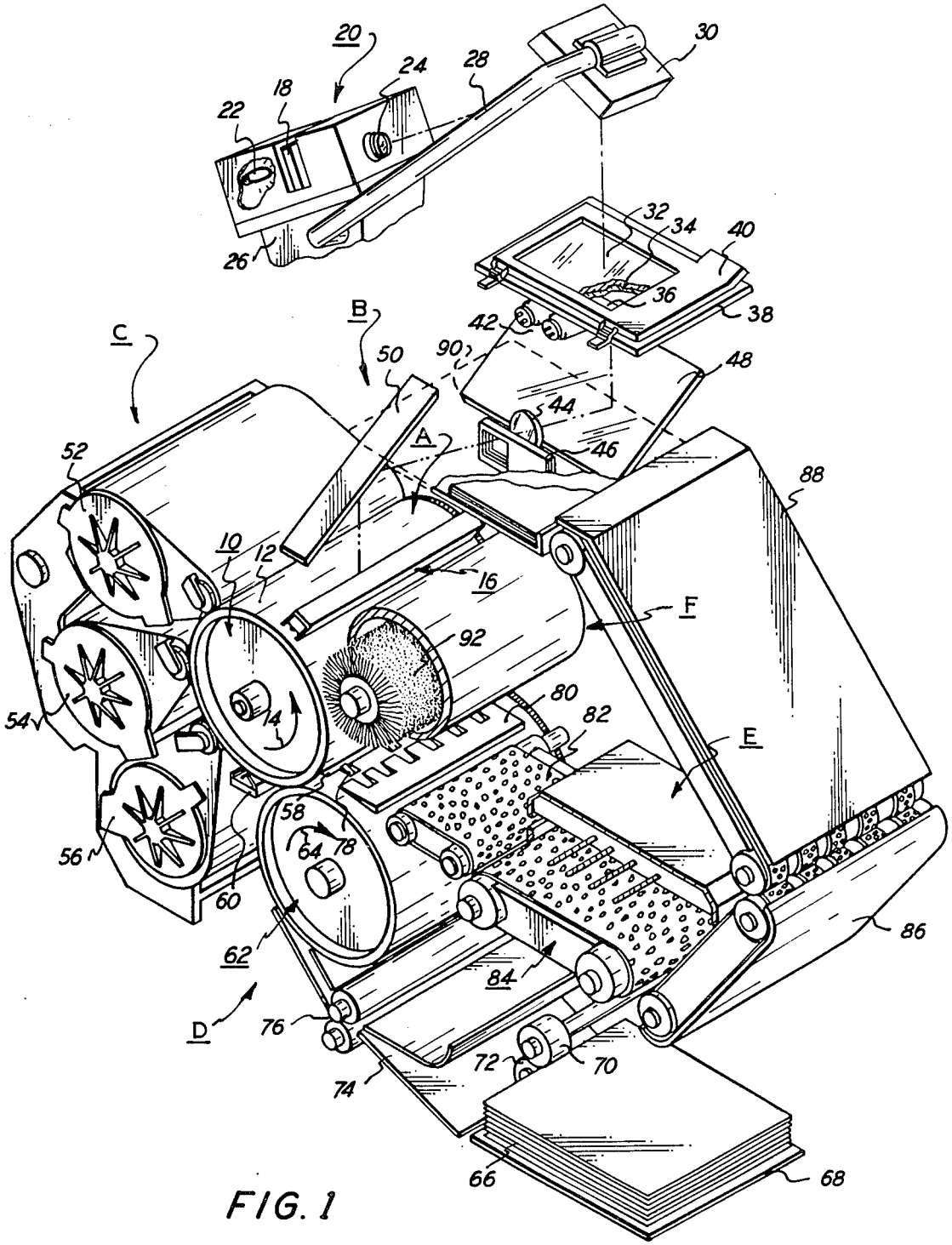
FIG. 1 is a schematic perspective view illustrating an electrophotographic printing machine incorporating the features of the present invention therein.

For a general understanding of an electrophotographic printing machine incorporating the features of the present invention therein, reference is had to FIG. 1. In the drawings, like reference numerals have been used throughout to designate idential elements. FIG. 1 depicts a multi-color electrophotographic printing machine arranged to produce color opaque copies from a color transparency. Although the particular feature of the present invention is directed to a screen employed in a color electrophotographic printing machine, it should become evident from the following discussion that the screen is equally well suited for use in a wide variety of electrostatographic printing devices and is not necessarily limited to the particular embodiment described herein. Hereinafter, an electrophotographic printing machine will be discussed as a preferred embodiment for apparatus employing the screen of the present invention.

As shown in FIG. 1, the electrophotographic printing machine includes a photoconductive member having a rotatable drum 10 with a photoconductive surface 12 entrained thereabout and secured thereto. Photoconductive surface 12 is made preferably from a polychromatic selenium alloy of the type described in U.S. Pat. No. 3,655,377 issued to Sechak in 1972. A signal generator (not shown) rotates in conjunction with drum 10 to activate sequentially the various processing stations within the printing machine.

For purposes of the present invention, each processing station operating in the electrophotographic printing machine will be described briefly hereinafter.

As drum 10 rotates in the direction of arrow 14, it passes through charging station A. Charging station A has a corona generating device, indicated generally by the reference numeral 16, disposed therein. Corona generating device 16 charges at least a portion of photoconductive surface 12 to a relatively high substantially uniform level. A suitable corona generating device is described in U.S. Pat. No. 3,875,407 issued to Hayne in 1975. After photoconductive surface 12 is charged to a substantially uniform level, drum 10 rotates the charged portion thereof, to exposure station B.

At exposure station B, the charged area of photoconductive surface 12 is exposed to a color filtered light image of color transparency 18, e.g., a 35 mm slide. Color transparency 18 is positioned in slide projector 20 which includes a light source 22 adapted to provide illumination therefore. Slide projector 20 comprises a lens 24 having an adjustable focus to produce an enlarged or magnified image of color transparency 18. As shown in FIG. 1, slide projector 20 is mounted on frame 26 secured to the printing machine. Arm 28 extends outwardly therefrom and has one end thereof mounted pivotably thereon. Mirror 30 is mounted rotatably on the other end of arm 28. In this manner, the light image projected from slide projector 20 is directed in a downwardly direction through a field lens 32, e.g., a Fresnel lens, screen 34, and composition frame 36 disposed on transparent platen 38. Fresnel lens 32 and screen 34 are mounted contiguous with one another in frame 40, e.g., Fresnel lens 32 and screen 34 are sandwiched together in frame 40. Composition frame 36 may be employed to provide a border around the opaque copy or a border containing additional indicia not found in transparency 18. In one embodiment, lens 32 is interposed between platen 38 and screen 34. Alternatively, screen 34 may be interposed between field lens 32 and platen 38. When composition frame 36 is employed, it is positioned immediately adjacent to platen 38 with field lens 32 and screen 34 being disposed thereover. The border of composition frame 36 extends in an outward direction from the enlarged light image of the color transparency. The color transparency is displayed visually on screen 34. In addition, screen 34 modulates the light image of the color transparency to form a half-tone light image which is combined with a light image of the composition frame.

As shown in FIG. 1, the light image of the color transparency is reflected in a downwardly direction by mirror 30, to pass through screen 34 so as to be modulated thereby. Lamps 42 moves in a timed relationship with lens 44 and filter mechanism 46 to scan and illuminate successive incremental areas of composition frame 36. The light image of the transparency and composition frame is reflected by mirror 48 through lens 44 and filter 46 forming a single color light image. The single color light image is reflected by mirror 50 in the downwardly direction onto the charged portion of photoconductive surface 12. Thus, the modulated single color light image irradiates the charged portion of photoconductive surface 12 recording a single color electrostatic latent image thereon. Similarly, the light image of composition frame 36 irradiates the charges portion of photoconductive surface 12 forming an unmodulated light image thereon in registration with the single color electrostatic latent image formed from the modulated light image of the color transparency.

Filter mechanism 46 interposes selected color filters into the optical light path of lens 44 during the exposure process. The appropriate filter operates on the light rays transmitted through lens 44 to form a light image corresponding to a single color of the transparency.

As heretofor indicated, lamps 42 are arranged to traverse platen 38 illuminating incremental widths of composition frame 36. Lamps 42 are mounted on a suitable carriage (not shown) which is driven by cable pulley system (not shown) from a drive motor (not shown) which rotates drum 10. As the lamp carriage traverses platen 38 another cable pulley system (not shown) moves lens 44 and filter 46 at a correlated speed therewith. Filter mechanism 46 is mounted on a suitable bracket extending from lens 44 to move in conjunction therewith. Lamps 42, lens 44, filter 46 all combine to form a flowing light image which is projected onto the charged portion of photoconductive surface 12. Preferably, projector 20 is a Kodak Carousel 600 projector having a F/3.5 Ektanar C projection lens with a quartz lamp light source.

Field lens 32 is preferably a Fresnel lens comprising recurring, light deflecting elements that will, as an entire unit, achieve a uniform distribution of light over a predetermined area. The gratings or grooves therein are preferably about 200 or more per inch. Fresnel lens 32 converges the diverging light rays from lens 24. Other suitable field lenses may be employed in lieu of a Fresnel lens. The light image of the color transparency passes through a screen which modulates it forming a half-tone light image. Hence, a modulated light image is combined with the image of composition frame 36 and incremental areas thereof are projected onto photoconductive surface 12 discharging the charge thereon. For further details regarding the drive mechanism of the optical system, reference is had to U.S. Pat. No. 3,062,108 issued to Mayo et al in 1962.

Preferably, lens 44 is a six-element split dagor type of lens having front and back compound lens components with a centrally located diaphragm therebetween. Lens 44 forms a high quality image with a field angle of about 31° and a speed ranging from about F/4.5 to about F/8.5 at a 1:1 magnification. Moreover, lens 44 is designed to minimize the effect of secondary color in the image plane. The front lens component has three lens elements including, in the following order; a first lens element of positive power, a second lens element of negative power cemented to the first lens element, and a third lens element of positive power disposed between the second lens element and the diaphragm. The back lens component also has three similar lens elements positioned so that lens 44 is symmetrical. Specifically, the first lens element of the front component is a double convex lens, the second element a double concave lens, and third element a convex-concave lens element. For greater details regarding lens 44, reference is made to U.S. Pat. No. 3,592,531 issued to McCrobie in 1971.

With continued reference to FIG. 1, filter 46 includes a housing which is mounted on lens 44 by a suitable bracket that moves with lens 44 during scanning as a single unit. The housing of filter 46 includes a window which is positioned relative to lens 44 permitting the light rays of the combined image, i.e., that of the composition frame and transparency to pass therethrough. Bottom and top walls of the housing include a plurality of tracks extending the entire width thereof. Each of the tracks is adapted to carry a filter permitting the movement thereof from an inoperative position to an operative position. In the operative position, the filter is located in the window of the housing permitting light rays to pass therethrough. Preferably, three filters are employed in the electrophotographic printing machine, a red filter, a blue filter and a green filter. A detailed description of the filter mechanism is found in U.S. Pat. No. 3,775,006 issued to Hartman et al in 1973. The detailed structure of screen 34 will be described hereinafter with reference to FIGS. 2 through 4, inclusive.

After the electrostatic latent image is recorded on photoconductive surface 12, drum 10 rotates it to development station C. At development station C three individual developer units, generally indicated by the reference numerals 52, 54 and 56, respectively, are arranged to render visible the electrostatic latent image on photoconductive surface 12. Preferably, each of the developer units is of the type generally referred to in the art as "a magnetic brush developer unit". A typical magnetic brush developer unit employs a magnetizable developer mix which includes carrier granules and heat settable toner particles. In operation, the developer mix is continually brought through a directional flux field forming a chain-like array of fibers extending outwardly from a developer roll. This chain-like array of fibers is frequently termed a brush. The electrostatic latent image recorded on photoconductive surface 12 is rotated into contact with the brush of developer mix. Toner particles are attracted from the carrier granules to the light image. Each of the developer units contain appropriately colored toner particles. For example, a green filtered light image is developed by depositing magenta toner particles thereon. Similarly, a red filtered light image is developed with cyan toner particles and a blue filtered light image with yellow toner particles. A development system of this type is described in U.S. Pat. No. 3,854,449 issued to Davidson in 1974.

After the single color electrostatic latent image is developed, drum 10 rotates it to transfer station D. At transfer station D, the toner powder image adhering electrostatically to photoconductive surface 12 is transferred to a sheet of support material 58. Support material 58 may be plain paper or a sheet of plastic material, amongst others. Transfer station D includes corona generating means, indicated generally at 60, and a transfer roll designated generally by the reference numeral 62. Corona generator 60 is excited with an alternating current and arranged to precondition the tone powder image adhering electrostatically to photoconductive surface 12. In this manner, the preconditioned toner powder image will be more readily transferred from the electrostatic latent image recorded on photoconductive surface 12 to support material 58 secured releasably on transfer roll 62. Transfer roll 62 recirculates support material 58 and is electrically biased to a potential of sufficient magnitude and polarity to attract electrostatically the pre-conditioned toner particles from the latent image recorded on photoconductive surface 12 to support material 58. Drum 10 and transfer roll 62 rotate in synchronism with one another, thereby maintaining support material 58 in registration with the electrostatic latent image recorded on photoconductive surface 12. Transfer roll 62 rotates in the direction of arrow 64. This enables successive toner powder images to be transferred to support material 58, in superimposed registration with one another. U.S. Pat. No. 3,838,918 issued to Fisher in 1974 discloses such a transfer system.

Turning now to a brief description of the sheet feeding path, support material 58 is advanced from a stack 66 mounted on tray 68. Feed roll 70, in operative communication with retard roll 72 advances and separates the uppermost sheet from stack 66. The advancing sheet moves into chute 74 which directs it into the nip between register rolls 76. Register rolls 76 align and forward the sheet to gripper fingers 78 which secure support material 58 releasably on transfer roll 62. After the requisite number of toner powder images have been transferred to support material 58, gripper fingers 78 release support material 58 and space it from transfer roll 62. As transfer roll 62 continues to rotate in the direction of arrow 64, stripper bar 80 is interposed therebetween. In this manner, support material 58 passes over stripper bar 80 onto belt conveyor 82. Belt conveyor 82 advances support material 58 to fixing station E.

At fixing station E, a fuser indicated generally by the reference numeral 84, generates sufficient heat to permanently affix the multi-layered powder image to support material 58. A suitable fusing device is described in U.S. Pat. No. 3,781,156 issued to Tsilibes et al in 1973. After the fixing process, support material 58 is advanced by endless belt conveyors 86 and 88 to catch tray 90 permitting the machine operator to remove the finished color copy from the printing machine.

Although a preponderance of the toner particles are transferred to support material 58, invariably some residual toner particles adhere to photoconductive surface after the transfer process. These residual toner particles are removed from photoconductive surface 12 at cleaning station F. Cleaning station F includes a cleaning corona generating device (not shown) for neutralizing the electrostatic charge remaining on the residual toner particles and photoconductive surface 12. The neutralized toner particles are cleaned from photoconductive surface 12 by a rotatably mounted fibrous brush 92 in contact therewith. A suitable brush cleaning device is described in U.S. Pat. No. 3,590,412 issued to Gerbasi in 1971.

It is believed that the foregoing description is sufficient for purposes of the present application to depict the general operation of the electrophotographic printing machine incorporating the features of the present invention therein.

Figure 2:
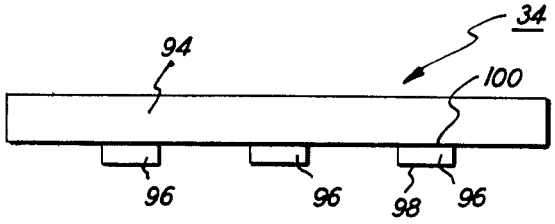
FIG. 2 is an elevational view showing a screen member employed in the FIG. 1 printing machine.

Referring now to FIG. 2, the specific features of the present invention are described therein. More particularly, screen 34 includes a substantially transparent sheet 94 made from a suitable plastic or glass. A plurality of spaced, opaque regions 96 such as dots are printed on the transparent sheet by a suitable chemical etching or photographic technique. The screen may be made from any number of opaque metallic materials suitable for chemical etching which is sufficiently thin to be flexible, such as copper or aluminum. The spacing between adjacent dots determines the quality of the resulting copy. A fine screen size generally results in a more natural or higher quality copy. With a finer screen, the screen pattern may be barely perceptable in the finished copy and the copy will have the appearance of a continuous tone photograph. A suitable dot screen may comprise about 85 dots per inch. However, this may range from about 65 to 300 dots per inch. The dot frequency is limited only by the optical system and the desired resolution.

Figure 3:
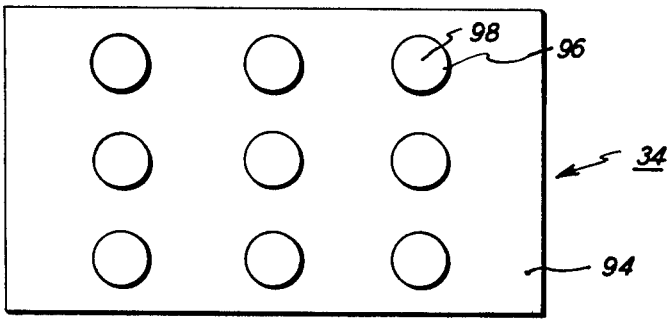
FIG. 3 is a bottom plan view of the FIG. 2 screen member.

Turning now to FIG. 3, there is shown a bottom view of the screen 34. As depicted thereat, dots 96 are arranged in transparent chute 94 in a substantially equally spaced array. Surface 98 of dots 96 is light absorbing. To this end, surface 98 is colored black.

Figure 4:
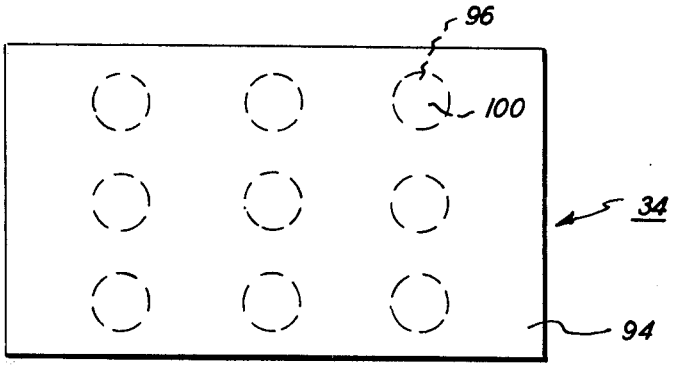
FIG. 4 is a top plan view of the FIG. 2 screen member.

Referring now to FIG. 4, screen member 34 has transparent sheet 94 in contact with light reflecting surface 100 of dots 96. Preferably, light reflecting surface 100 is colored white. In this manner, the incident light rays are absorbed by light absorbing surface 98, while the light rays impinging on surface 100 are reflected therefrom. Thus, dots 96 modulated the light image transmitted through transparent chute 94 while reflecting a light image corresponding to the color transparency being reproduced. This is achieved by positioning surface 98 of dots 96 in contact with platen 38 or in contact with field lens 32. In this way, reflecting surface 100 of dots 96 reflects the light image passing through chute 94 to form a visual light image thereat. This enables the light image formed on screen 34 to be suitably focused by adjusting lens 24 of slide projector 20.

In recapitulation, it is evident that the screen employed in the electrophotographic printing machine is arranged to modulate the light image of the transparency as well as forming a visual image thereof which may be suitably focused by the machine operator. This is achieved by a screen having a transparent chute with opaque regions thereon. At least a portion of the opaque regions have light reflecting surfaces on one side thereof and light absorbing surfaces on the other side thereof.

Hence, it is apparent that there has been provided, in accordance with the present invention, a screen for use in an electrophotographic printing machine that satisfies the objects, aims and advantages hereinbefore set forth. While this invention has been disclosed in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. An electrophotographic printing machine for reproducing a transparency, including:

a photoconductive member;

means for charging at least a portion of said photoconductive member to a substantially uniform level;

a screen member comprising a plurality of opaque regions with at least a portion thereof having a light reflecting surface on one side thereof and a light absorbing surface on the other side thereof; and means for projecting a light image of the transparency through said screen member onto the charged portion of said photoconductive member to record thereon a modulated electrostatic latent image, said screen member being positioned so that the reflecting surfaces of the opaque regions form a visual image of the transparency and the absorbing surfaces of the opaque regions absorb incident light rays.

2. A printing machine as recited in claim 1, further including:

a field lens in a light receiving relationship with the light image of the transparency; and means for supporting said field lens and said screen member.

3. A printing machine as recited in claim 2, wherein said supporting means includes a substantially transparent platen spaced from said photoconductive member.

4. A printing machine as recited in claim 3, wherein said field lens is interposed between said platen and said screen member.

5. A printing machine as recited in claim 3, wherein said screen member is interposed between said platen and said field lens.

6. A printing machine as recited in claim 3, further including:

a composition frame disposed on said platen; and means for exposing the charged portion of said photoconductive member to a light image of said composition frame recording thereon a combined electrostatic latent image of the transparency and the electrostatic latent image of said composition frame.

7. A printing machine as recited in claim 6 wherein said exposing means includes:

a light source arranged to illuminate said composition frame; and a lens positioned to receive at least the light rays transmitted from said composition frame to form a light image thereof.

8. A printing machine as recited in claim 6, wherein said screen member includes a transparent substrate with the opaque region thereof being a plurality of spaced dots disposed on said transparent substrate.

9. A printing machine as recited in claim 8, wherein said projecting means includes a slide projector.

10. A printing machine as recited in claim 9, further including:

means for filtering the light image of the transparency to form a single color light image which irradiates the charged portion of said photoconductive member to record thereon a single color electrostatic latent image;

means for developing the single color electrostatic latent image recorded on said photoconductive member with toner particles complementary in color to the color of the single color light image;

means for transferring the toner powder image from the electrostatic latent image recorded on said photoconductive member to a sheet of support material; and means for permanently affixing the toner powder image to the sheet of support material.

11. A screen for use in an electrophotographic printing machine, including:

a substantially transparent member; and a plurality of opaque regions disposed on said transparent member with at least a portion of said opaque regions having a light reflecting surface on one side thereof and a light absorbing surface on the other side thereof.

12. A screen as recited in claim 11, wherein said opaque regions include a plurality of dots.

13. A screen as recited in claim 12, wherein the light reflecting surface of said dots is white and the light absorbing surface of said dots is black.

14. A screen as recited in claim 13, wherein the white surface of said dots contacts one surface of said transparent member.

15. A screen as recited in claim 14, wherein said dots are arranged in a substantially equally spaced array on said transparent member.

* * * * *